United States Patent [19]

Hara

[11] Patent Number: 4,818,328

[45] Date of Patent: Apr. 4, 1989

[54] PROCESS FOR MANUFACTURING SACKS, BAGS, AND THE LIKE

[75] Inventor: Toshiya Hara, Tokyo, Japan

[73] Assignee: Oji Seitai Kaisha, Ltd., Tokyo, Japan

[21] Appl. No.: 140,234

[22] Filed: Dec. 31, 1987

Related U.S. Application Data

[63] Continuation of Ser. No. 607,136, May 4, 1984.

[30] Foreign Application Priority Data

May 9, 1983 [JP] Japan ..... 58-79339

[51] Int. Cl.[4] ..... B65B 13/02

[52] U.S. Cl. ..... 156/350; 53/118; 156/446; 156/554

[58] Field of Search ..... 53/430, 118, 119; 493/199–203, 210, 218–219; 156/184, 443, 446, 187, 350, 554; 414/684, 911

[56] References Cited

U.S. PATENT DOCUMENTS 4,063,693 12/1977 Achelpohl et al. ..... 53/118 X
4,240,336 12/1980 Grevich et al. ..... 493/201 X
4,434,948 3/1984 Feldkamper ..... 53/118 X
4,707,968 11/1987 Vosters ..... 53/430

*Primary Examiner*—David Simmons
*Attorney, Agent, or Firm*—Burns, Doane, Swecker & Mathis

[57] ABSTRACT

In a process for manufacturing sacks of sheet material, flat tubes are fed one by one in the direction perpendicular to the discharging direction thereof, while the tubes are overlapped or shingled as offset by a predetermined distance. The tubes are wound one by one on a reel core with the help of a tape, which is connected at one end thereof to the reel core and continuously supplied with the rotation of the reel core. The tubes are secured on the reel core outside pressure supplied by the tape to form a tube wound reel having a desired diameter. After a certain time period and immediately before the susequent bottom-closing process, the tubes are unwound from the reel core by pulling the tape to rotate the reel. The overlapped tubes are then separated from each other and supplied one by one to a bottom-closing station.

10 Claims, 4 Drawing Sheets

PROCESS FOR MANUFACTURING SACKS, BAGS, AND THE LIKE

This application is a continuation of Ser. No. 607,136, filed May 4, 1984.

BACKGROUND OF THE INVENTION

1. Field of the Invention

This invention relates to a process for manufacturing sacks, bags, or the like, hereinafter referred to as "sacks", and more particularly to a process including a tube-making step and bottom-closing step, especially advantageously adaptable for manufacturing heavy duty sacks.

2. Description of the Prior Art

There is a conventionally known process for manufacturing heavy-duty sacks, comprising mainly of a step for making tube segments from sheet material, such as, kraft paper, and a bottom-closing step that includes sewing, stitching, or pasting the bottoms of the tube segments. The tube segments are discharged in a flat form from the tube-making station, are usually stacked manually on a pallet, and the stacked tube segments are pressed, for instance, by placing a suitable weight on top of the stack them until the longitudinal paste, having been applied to the tube during the tube-making step, has dried. After being dried, the tube segments are removed from the pallet and are manually charged one by one into the bottom-closing station.

Recently, in order to increase the production-rate and eliminate some of the manual labor involved, an automatic tube feeder is used to supply the tube segments to the bottom-closing station. However, it is still necessary to manually charge the automatic tube feeder with packets of 20 to 30 tube segments.

According to these conventional processes during the period in which the tube segments are in stacks, after discharge from the tube-making station, the tube segments are subjected to "waving" or "undulation", which can have an adverse affect on the bottom-closing process, causing the production of unacceptable quality sacks.

To solve the above-mentioned problems, a method has been proposed for directly connecting the tube-making station with the bottom-closing station by a conveyor-system. However, this conveyor must be extremely long, since the tube segments must be kept under pressure until the longitudinal paste has dried, as mentioned above, which means that a large area must be provided for the conveyor-system, making the proposed method both expensive and uneconomical.

In another prior art, as disclosed in Japanese Unexamined Patent Publication (Kokai) No. 52-44973, in order to store or transport sacks discharged at a high speed from a sack-making machine, or to thereafter prepare the finished sacks for separating them from each other and supplying them to a sack-filling station, the sacks are overlapped or shingled in the longitudinal or axial direction of the finished sacks, and are wound into a reel with the help of winding tapes.

Hithertobefore, however, it has been unknown that, in a sack manufacturing process, the open-ends tube segments discharged from the tube making step are overlapped or shingled as offset by a certain distance and fed to be wound on a reel in the direction perpendicular to the discharging or longitudinal direction of the tube segments with the help of winding tapes, and thereafter the tube segments are unwound being synchronized with the bottom-closing step and separated from each other to supply them into a bottom-closing step where one or both ends (bottoms) of the tube segments are closed.

SUMMARY OF THE INVENTION

Accordingly, it is an object of the present invention to provide a new and improved process for manufacturing sacks, capable of obviating the disadvantages or problems as mentioned above in connection to the prior art.

Another object of the present invention is to provide a process for manufacturing sacks, capable of cutting-back on manual labor through a relatively small investment, and capable of improving the quality of the sacks manufactured.

According to the present invention, there is provided a process for manufacturing sacks, bags, or the like, comprising: a step for making tube segments of a sheet material; a step for feeding the tube segment one by one in a flat form in a direction substantially perpendicular to the discharging direction thereof, while the tube segments are overlapped one over the other and stepped one by one by a predetermined distance; a step for winding the flat tube segments one by one onto a reel core with the help of at least one tape member, which is connected at one end thereof to the reel core and continuously supplied with the rotation of the reel core, so that the tube segments are secured to the reel core by applying the tape member alternately to the tube segments from the outside thereof, to form a tube wound reel having a desired diameter; a step for unwinding the tube segments one by one from the reel core, immediately before the subsequent bottom-closing process, by pulling on the tape member so that it causes the tube wound reel to rotate; a step for taking up the overlapped tube segments one by one separating the individual tube segments from each other, and supplying them one by one into a bottom-closing station; and, finally, a step for carrying out bottom-closing while the separated individual tube segments are fed one by one to the bottom-closing station in the direction substantially perpendicular to the axial direction thereof.

The bottom-closing step is advantageous in that it comprises a step for sewing or stitching, or a valve-forming process and bottom-sewing or stitching process, or hexagonal bottom-forming and bottom-pasting processes, or pinch-type bottom-forming and bottom-pasting processes.

The claimed invention makes it possible to automatically remove the discharged tube segments one by one from the tube making station, without necessitating a large investment, and also to automatically supply them one by one to the bottom-closing station at a high speed, thereby attaining a higher production-rate than that attained by conventional sack manufacturing processes.

In addition, according to the present invention, unfavorable deformation such as waving or undulation, which has an adverse affect at the subsequent bottoming process, can be obviated, since the tube segments are not stacked in the same manner as in the prior art described above. Longitudinal pleats or undulations are also formed on the tube segments while they remain wound on the reel core in the overlapped and stepped condition, thereby increasing the longitudinal stiffness of the tube segments. Thus, in the bottom-closing station, misalignment of a capping tape or sewing line can be avoided in case of comprising sewing process. Accurate valve-formation can be obtained in case of comprising valve-forming process, and accurate bottom creasing can be obtained in case of comprising bottom-pasting process. In any case, therefore, accurate positioning or aligning of tubes in longitudinal direction thereof on the bottoming step can be obtained, which makes it possible to considerably reduce unacceptable sacks when compared with that of conventional sack manufacturing processes.

In an embodiment of this invention, the tube segments are fed one by one by a conveyor belt, immediately after being unwound from the reel core, and are passed between at least two pairs of rollers, spaced from each other at a distance just slightly larger than the width of each tube segment in the feeding direction, and the tube segments are separated from each other by driving the subsequent pair of rollers at a higher speed than that of the preceeding pair of rollers.

This embodiment makes it possible to supply the tube segments into the bottom-closing station at a considerable high speed in comparison with an automatic suction type feeder conventionally known in the art.

DETAILED DESCRIPTION OF THE PREFERRED EMBODIMENTS

Referring now to the several drawings, the preferred embodiments of the present invention will be described in detail. It is, however, to be understood that this invention is not limited to the specific embodiments, but is applicable to various variations or modifications within the scope of the present invention defined in the appended claims.

Figure 1:
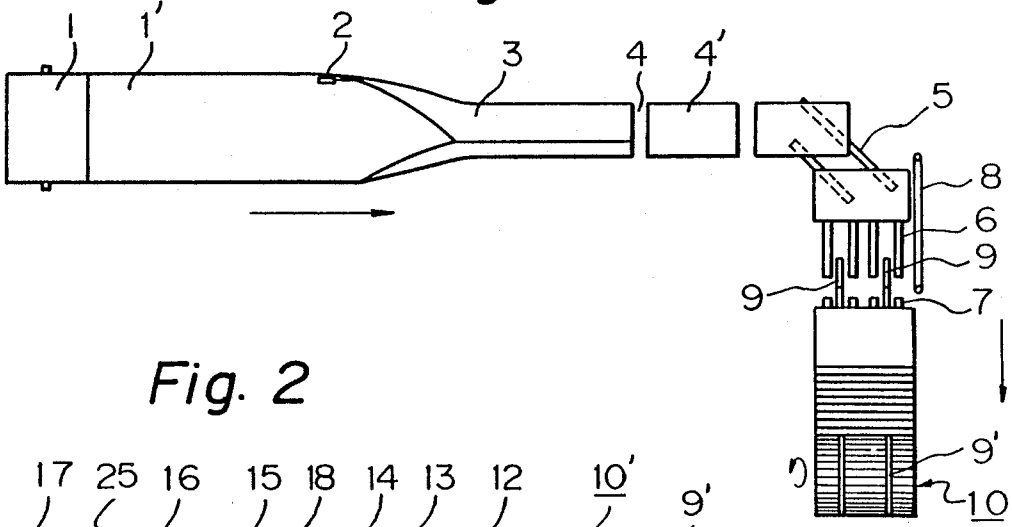
FIG. 1 is a plan view schematically illustrating a tube making process according to the present invention.
Figure 2:
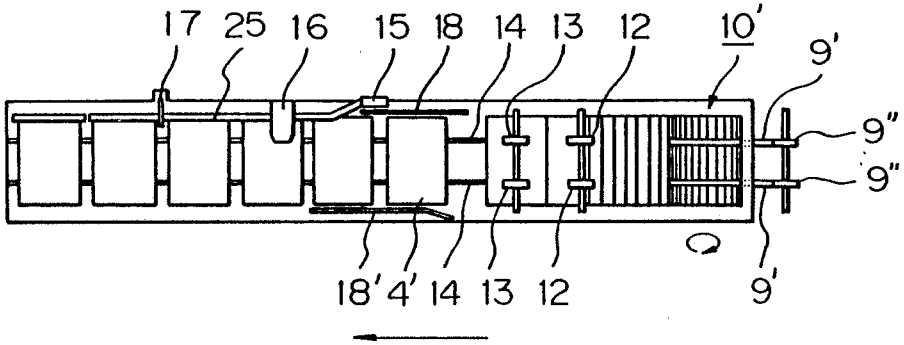
FIG. 2 is a plan view schematically illustrating a bottom-forming or closing process according to the present invention.

FIGS. 1 and 2 illustrate a process for making sacks according to the present invention, i.e., a process for making tube segments and a process for bottoming, such as by sewing, in sequence, respectively. In these drawings, reference numeral 1 denotes a reel unwinding station; 1' a sheet web, such as kraft paper; 2 a longitudinally pasting station; 3 a tubing station; 4 a cutting station; 4' tube segments; 5 (45°) turning conveyors; 6 and 7 conveyor belts; 8 guide belts; 9 a tape unwinding station; 9' retaining or securing tapes; 10 a tube winding or reeling station; 9'' a tape rewinding station; 10' a tube unwinding or unreeling station; 12 feeding rollers; 13 accelerating rollers; 14 transport- or carrier-chains; 15 a capping tape unwinder; 16 a sewing or stitching station; 17 a tape cutter for the capping tape; and 18 and 18' guide plates.

Figure 3:
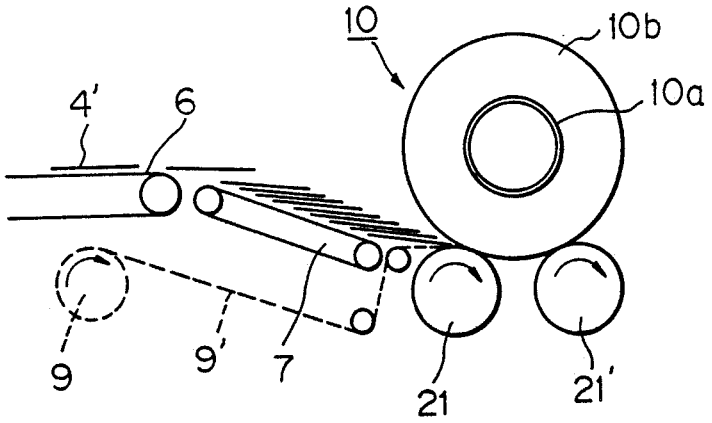
FIG. 3 is an elevational view of a station for winding tube segments onto a reel in the tube-making process shown in FIG. 1.

FIG. 3 is an elevational view of a part of the tube making process shown in FIG. 1, i.e., the downstream portions of the tube conveyor belts 7 in FIG. 1, wherein 4', 6, 7, 9, 9', and 10 denote the same or corresponding parts as illustrated in FIG. 1, and reference numeral **10*a* denotes a reel core; 10*b* tube-reel, and 21 and 21'** reel supporting rollers.

Figure 4:
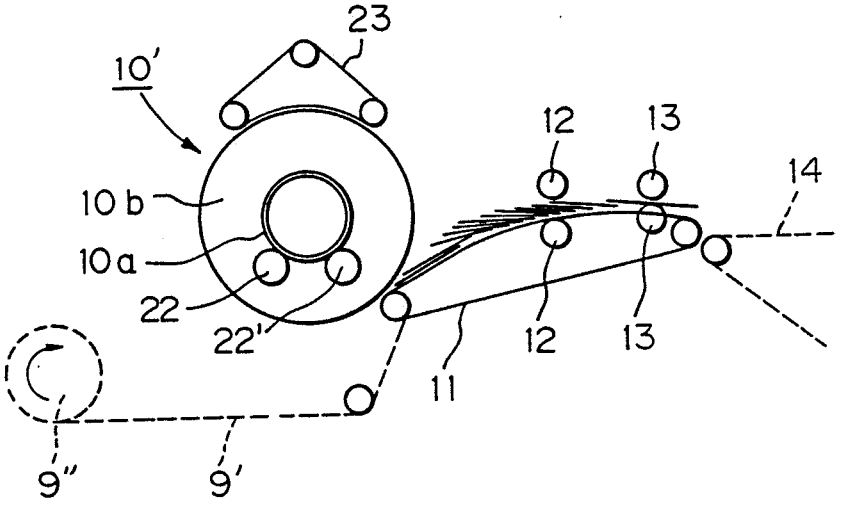
FIG. 4 is an elevation view of a station for unwinding tube segments from the reel in the bottom closing process shown in FIG. 2.

FIG. 4 is an elevational view of a part of the bottoming or bottom closing process shown in FIG. 2, i.e., the upstream portions of the tube conveyor belts 11 in FIG. 2, wherein reference numerals 9', 9'', 10', and 12 through 14 denote the same or parts corresponding to those illustrated in FIG. 2, and reference numeral 11 denotes a tube conveyor belt; 22 and 22' core supporting rollers; and 23 a pushing belt assembly.

In FIG. 1, in the tube-making process according to the present invention, a longitudinal sheet web of any suitable material, such as paper, for instance kraft paper, or woven plastics, is fed or unwound longitudinally from a sheet feeding station 1 and applied to with paste by one of the side edges of the sheet in its longitudinal direction at a longitudinally pasting station 2. A sheet web 1' is then formed into a tube at the tubing station 3. Said tube is then cut at a cutting station 4 into individual tube segments 4' having a predetermined indentical length. The tube segmants 4' are fed one by one in the longitudinal direction by means of a suitable conveyor, not illustrated in FIG. 1.

The above-mentioned process for making tube segments can be found in the conventionally known prior art.

In case of making multi-ply tubes, a plurality of sheet-feeding stations can be provided. Between the sheet feeding station 1 and the paste applying station 2, a printing station(s), a station(s) for transversly pasting the sheet web(s) in a predetermined interval, or a perforating station(s) for forming stepped end tubes may be provided. The cutting station 4 can be of any type, such as, one having knife bars for flush cut, notch-cut, or "econo-cut (interlocking notch-cut)", or one having pressure bars for severing pre-perforated tubes to manufacture stepped-end tubes.

According to the present invention, the tube segments 4', each having cut into a predetermined length, are then fed (downwardly in FIG. 1) perpendicularly to the longitudinal direction of the tube segments, i.e., to the feeding direction up-to-now, by means of, such as the 45° turning conveyor 5 and the guide belt 8, as illustrated in the instant embodiment, by which the tube segments 4' are transported onto the tube feeding belts 6 and then onto the belts 7.

Referring now to FIG. 3, the tube feeding belts 7 are running slowly, at the speed of one-eighth to one-tenth of the speed of the tube feeding belts 6, so that the flat tube segments 4' are overlapped at a predetermined distance, preferably 30 mm to 50 mm, on the feeding belts 7. On the other hand, the longitudinal tapes 9' are parallely unwound from the tape reels 9'' and introduced through a tape passage as shown in FIG. 3 into the reel core **10*a*, and one end of the tapes are connected to the reel core 10*a*. The reel core 10*a* is placed on the two tube reel supporting rollers 21 and 21' both rotating at a circumferential speed 30% to 100% faster than those of the tube feeding belts 7, so that the reel core 10*a* is rotated on and by the supporting rollers 21 and 21' and the tapes 9' are wound onto the periphery thereof at a faster speed than the tube feeding belts 7** to smoothly wind up the tube segments.

Consequently, the flat tube segments 4' overlapped or shingled as offset by a predetermined distance, such as 30 to 50 mm, on the tube-feeding belts 7 are led or guided on and by the tapes 9' onto the reel core 10*a* and wound thereon one by one in the overlapped or shingled as offset, by a distance of 40 to 100 mm, and in the tightened condition by virtue of the tapes 9'. In order to ensure tight winding of the tube segments 4' onto the reel core 10*a*, the tapes 9' are subjected to a braking force at the tape unwinding station 9.

According to experiments having been conducted by the inventors, it has been found that the diameter of the reel core 10*a* is preferably 300 to 500 mm, and the tube segments are preferably wound in such a manner that the maximum diameter of the tube reel 10*b*, including the wound tube segments 4', becomes about 1500 mm. That is to say, tube segments 4' each consisting of three plies of extendable papers of 78 g/sqm., commercially available under "Culpak", the trademark, and having gussets were overlapped at an interval of approximately 50 mm on the tube feedng belts 7, each segment having a tube face width of 419 mm, and gusset-depth of 38 mm, were wound on a reel core having outer diameter of 470 mm, such that 4500 tube segments were overlapped thereon at an interval of approximately 80 mm, until the outer diameter of the tube reel 10*b* including the wound tube segments became approximately 1500 mm. After ten days had passed, the tube segments 4' were removed by unwinding the tube reel 10*b* and the succeeding bottoming process carried out. Through these experiments, it was confirmed that the tube segments 4' had not been subjected to any unfavorable deformation which would adversely affect the subsequent bottoming process.

In this embodiment, the reel core 10*a* is axially longer than the width of the tube reel 10*b* to extend from the respective ends of the latter, in order to make the reel core 10*a* adaptable to the particular construction of the tube unwinding station 10' (see FIG. 4) in the bottoming process, as described hereinafter in detail.

Figure 5:
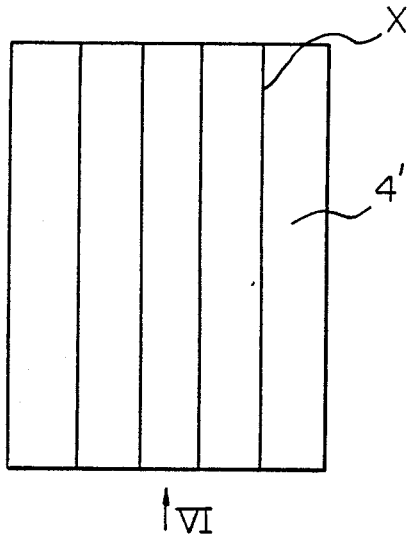
FIG. 5 is a plan view of a single flat tube segment after having been unwound from the reel-unwinding station.
Figure 6:
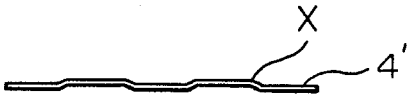
FIG. 6 is an elevation view of the flat tube segment viewed from the direction of an arrow VI in FIG. 5.

Since the tube segments 4' are wound and kept as the tube reel 10*b*, under the condition of overlapped at certain intervals, and retained or secured from the outside by means of the tapes 9', as mentioned above, the tube segments 4' are readily urged or pressed to each other, especially toward the lateral edges of the adjacent tube segments, so that several longitudinal slight undulations or pleats are formed over the entire length of each tube segment, as shown in FIGS. 5 and 6, in a plan view and an elevation view, respectively, of the tube segment 4' after having been unwound from the tube reel 10*b*, under the conditions as mentioned above, and allowed to return to a flat status. In FIGS. 5 and 6, reference X denotes the longitudinal slight undulations formed longitudinally on the tube segment 4' as mentioned above. These longitudinal undulations X serve to increase the longitudinal stiffness of the tube segment, and to prevent it from bending perpendicularly with respect to the feeding direction in the subsequent bottoming process, as will be mentioned hereinafter.

According to the present invention, immediately before being charged to the bottoming process, the tube segments 4' are continuously taken out one by one by unwinding the tube reel 10*b*, and then separated from each other before supplying them one by one to the bottom-closing station. Thus, referring to FIG. 4, the tube reel 10*b* having been formed at the tube-winding station 10 is placed on the tube-unwinding station 10' in the bottoming process in such a manner that the respective of the reel core 10*a* extended from the tube reel 10*b* are supported on a pair of core supporting rollers 22 and 22'.

In the tube unwinding or unreeling station 10', the tapes 9' are drawn through a passage, as shown in FIG. 4, to the tape rewnnding station 9'' and wound thereon at a predetermined speed. As the results, the tube reel 10*b* is rotated while being supported on the above-mentioned core supporting rollers 22 and 22' and the tapes 9' are unwound from the tube reel 10*b*.

A tube-reel holding belt assembly 23 is vertically movably mounted on a frame member, not shown in the drawing, and located on the tube reel 10*b*. The belt assembly 23 is driven at a slightly slower circumferential speed than that of the above-mentioned tapes 9', and an appropriate bracking force is exerted on the tube reel 10*b* so that the latter does not rotate at a higher circumferential speed than that of the tape 9' being wound onto the tape rewinding station 9'' from the tube reel 10*b*.

Thus, the tube segments 4' having been retained by the tapes 9' on the tube reel 10*b* are released one by one from the tapes 9' onto the tube feeding belts 11. It is desirable that the circumferential speed of the tube feeding belts 11 is the same as the speed of the tapes 9'.

Pairs of feeding rollers 12 and accelerating rollers 13 are provided, respectively, adjacent to the rear ends of the tube feeding belts 11. In this particular embodiment, there are two pairs of such rollers 12 and 13, respectively, the rollers 13 being spaced from the rollers 12 in the feeding direction by a distance a little greater than the width of the flat tube segment, i.e., the dimension thereof along the feeding direction on the tube feeding belts 11. The feeding rollers 12 are driven at approximately the same circumferential speed as that of the tube feeding belts 11, while the accelerating rollers 13 are driven at a speed approximately ten times faster. Thus, immediately after the rear edge of the preceeding tube segment 4' passes over the rollers 12, it is caught by the accelerating rollers 13, and the tube segment is fed forward at a speed ten times faster than the previous speed. At this moment, the succeeding tube segment 4' is caught by the rollers 12 and moved forward at the same speed as the tube feeding belts 11. Thus, the preceeding tube segment is completely separated from the subsequent tube segment, which is transferred onto the transport chains 14 and supplied to the bottoming station.

As the tube segments 4' are transferred to the transport chains 14 one by one, while being held by the rollers 12 and then rollers 13 at both front and back faces thereof, the longitudinal undulations or pleats X formed on the tube segments are not affected when supplied to the bottoming station, as is sometimes experienced with a conventional automatic suction-type feeder. Therefore, the tube segments, even with gussets, can be reliably supplied one by one to the bottoming station at a high speed, e.g., more than 150 segments per minute.

The tube segments 4' supplied onto the transporting chains 14 are positioned in a known manner in such a way that the bottom edge of each tube segment 4' is aligned on a predetermined line, and a capping tape 25 is provided from the capping tape unwinder 15 to the bottom edge of each tube segment 4'. At the sewing or stitching station 16, the bottom edge of the tube segment 4' is closed by sewing or stitching according to any conventional sewing process, and the capping tape 25 and the thread are then simultaneously cut by the tape cutter 17.

As mentioned hereinbefore, the tube segments 4' have sufficient stiffness in the longitudinal or axial direction thereof, obtained through the longitudinal slight undulations X, and the tube segments 4' are therefore prevented from bending perpendicularly to the feeding direction while being fed and positioned with their bottom edges along the guide plates 18 and 18'. Therefore, the capping tape 25 can be applied as closely as possible over the bottom edges of the tube segments 4', and a correct and uniform sewing line distance can be maintained across the tube width.

The longitudinal stiffness of the tube segments 4' is advantageous, not only in the bottoming process by sewing as in the instant embodiment, but also in a valve-forming process to increase the accuracy of the aligning or positioning of the tube segments, or in a hexagonal or pinch-type bottom-closing process to obtain exact bottom creasing(s), in that the stiffness is effective to reduce unacceptable sacks.

In the present invention, it should therefore be understood that the bottoming process may include not only the bottom sewing process as mentioned with reference to the particular embodiment, but also the valve-forming, or hexagonal or pinch-type bottom forming and pasting processes.

In addition, at the end of the tube-making process as illustrated in FIG. 1, two sets of systems each comprising the portions from the (45°) turning conveyor 5 through the tube reel station 10 may be provided. In this case, immediately after a first tube reel (10*b*) reaches a predetermined diameter, the subsequent tube segments 4' discharged from the tube-making process are fed by a second (45°) turning conveyor (5) to a second tube reel winding station where these tube segments may be wound.

On the other hand, in the bottom forming process as illustrated in FIG. 2, two sets of tube reel unwinding stations 10' can be provided in tandem. In this case, immediately after the last tube segment is unwound or discharged from a first tube reel (10*b*) in the first reel unwinding station, tube segments are to be discharged from a second tube reel, which would be prepared in advance at the second reel unwinding station.

Figure 7:
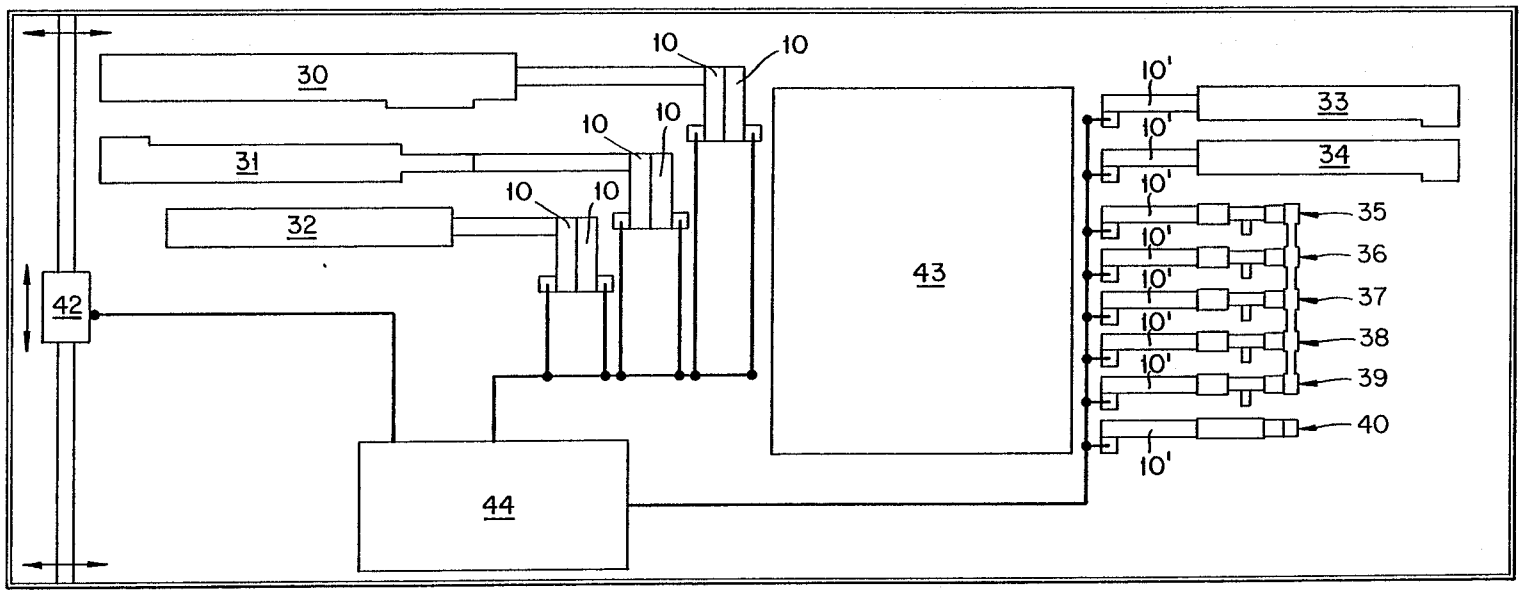
FIG. 7 is a plan view schematically illustrating an automated system for manufacturing sacks, bags and the like according to the present invention.

As shown in FIG. 7 if there are a plurality of tube-making machines 30, 31, 32; and bottom-closing machines, 33–34 the tube wound reels can be removed from the tube winding stations 10 by a computer controlled automatic crane 42 and stored on the floor 43 between the tube-making and bottom-closing machines. In this case, the product codes, reel numbers, stored positions, and etc. can be memorized in the computer, 44 so that a desired tube reel is picked up by the crane 42 on a basis of instruction signals from the bottom-closing machines and delivered to a designated unwinding station 10' adjacent the desired bottom-closing machine 33–34.

This arrangement makes the plant operation very flexible, when compared with the prior art in which a particular tube-making and bottom-closing machines are directly connected by a conveyor system, as described hereinbefore. In a direct connection system as in the prior art, in which one stepped-end tuber is connected to two bottomers through conveyors, sort of sack to be manufactured is limited to, such as, stepped-end flat tubes (for hexagonal pasted-bottom sacks), even though the stepped-end tuber is originally available for making not only the above-mentioned tubes, but also flush-cut gusseted tubes (for sewn sacks) or stepped-end gusseted tubes (for pinch-bottom sacks).

I claim:

1. A system for manufacturing sacks, bags, or the like, comprising:

a plurality of tube-making machines, each comprising a means for making tubes of sheet material, a means for discharging said tubes in an axial direction of the tubes, each of said tubes having open axial ends, a means for turning said tubes by substantially 90° so as to feed said tubes in flat form one by one in a direction substantially perpendicular to the axial direction of the tubes, the tubes being overlapped or shingled as offset by a predetermined distance;

a plurality of reeling stations, each comprising a means provided for each said tube-making machine, for winding said tubes one by one on a reel core with the axial direction being parallel to a reel core axis and with the help of at least one tape member which is connected at one end thereof to said reel core and is continuously supplied with the rotation of the reel core, so that the tubes are secured on the reel core by the tape member being applied to the tubes one by one from the outside thereof, to form a tube wound reel having a desired diameter;

a reel storing station for storing said tube wound reels;

a plurality of bottom-closing machines, each comprising a means for unwinding the tubes one by one from said reel core by pulling said tape member to rotate the tube wound reel, a means for taking up the overlapped tubes one by one and separating said individual tubes from each other, and a means for closing a bottom of each of said individual tubes, while said tubes are fed one by one in the direction substantially perpendicular to the axial direction of the tubes;

computer controlled crane means for removing said tube wound reels, in turn, from said reeling stations to put them in said reel storing station and picking a desired tube wound reel to deliver it to a designated one of said bottom-closing machines.

2. A system as set forth in claim 1, wherein said reeling station comprises a pair of parallel supporting rollers which freely support said reel core thereon and drive the reel core to wind up the overlapped tubes one by one as well as the tape member at a certain circumferential speed which is faster than the previous feeding speed of the tubes in the direction substantially perpendicular to the longitudinal direction thereof.

3. A system as set forth in claim 2, wherein said tape member is drawn from a reel thereof under a predetermined tension when it is wound on the reel core.

4. A system as set forth in claim 1, wherein said bottom-closing machine comprises a means for exerting a braking force to said tube wound reel, said means comprising a belt assembly which is in contact with said tube wound reel, when it is unwound by pulling the tape member.

5. A system as set forth in claim 1, wherein said bottom-closing machine comprises a means for supporting said tube wound reel in such a manner that the respective end portions of the reel core extending from the tubes are placed on respective pairs of rollers.

6. A system as set forth in claim 1, wherein said bottom-closing machine comprises a conveyor belt for feeding the tube segments one by one, immediately after said tube segments have been unwound from the reel core, and at least two pairs of rollers, spaced from each other by a distance a little larger than the width of each tubes in the feeding direction, and the subsequent pair of rollers rotate much faster than the preceding pair of rollers, to pass the tubes therebetween and separate the tubes from each other.

7. A system as set forth in claim 1, wherein said bottom-closing machine comprises means for sewing or stitching bottoms of the tubes one by one.

8. A system as set forth in claim 1, wherein said bottom-closing machine comprises valve forming means and sewing or stitching means.

9. A system as set forth in claim 1, wherein said bottom-closing machine comprises hexagonal bottom forming means and pasting means.

10. A system as set forth in claim 1, wherein said bottom-closing machine comprises pinch bottom forming means and pasting means.

* * * * *